US005156010A

United States Patent [19]

Inoue et al.

[11] Patent Number: 5,156,010

[45] Date of Patent: Oct. 20, 1992

[54] DEFROST CONTROL METHOD FOR A HEAT PUMP

[75] Inventors: Tetsuo Inoue, Ota; Masayuki Shimizu; Kikuo Takekawa, both of Oizumi; Hikaru Katsuki, Kiryu; Yuji Tsuchiyama, Nitta, all of Japan

[73] Assignee: Sanyo Electric Co., Ltd., Osaka, Japan

[21] Appl. No.: 715,242

[22] Filed: Jun. 14, 1991

[30] Foreign Application Priority Data

Jun. 18, 1990 [JP] Japan ..... 2-160975

[51] Int. Cl.[5] ..... F25D 21/06

[52] U.S. Cl. ..... 62/81; 62/156; 165/29

[58] Field of Search ..... 62/81, 155, 156, 140, 62/324.5; 165/29, 17

[56] References Cited

U.S. PATENT DOCUMENTS 4,790,144 12/1988 Yokouchi et al. ..... 62/156
4,852,360 8/1989 Harshbarger et al. ..... 62/156 X
4,903,500 2/1990 Hanson ..... 62/156

FOREIGN PATENT DOCUMENTS 0087733 7/1981 Japan ..... 62/156
0120035 7/1983 Japan ..... 62/155
0093138 5/1984 Japan ..... 62/155
0200145 11/1984 Japan ..... 62/155
0038544 2/1985 Japan ..... 62/155

*Primary Examiner*—John Rivell
*Attorney, Agent, or Firm*—Armstrong, Nikaido, Marmelstein, Kubovcik & Murray

[57] ABSTRACT

A method of defrost for an outdoor side heat exchanger in a heat pump having a refrigeration circuit in which a compressor, an indoor side heat exchanger, an expansion device and the outdoor side heat exchanger are connected together so that a heat collected in the outdoor side heat exchanger is radiated from the indoor side heat exchanger and that defrosting for the outdoor side heat exchanger is started when the outdoor heat exchanger is frosted, and a temperature sensor is provided to detect a temperature of the indoor side heat exchanger, wherein the defrosting is started when the temperature detected by the temperature sensor is not higher than a first predetermined level with a downward gradient, which is calculated on the basis of the temperature, of the same temperature becoming as sharp as, or sharper than, a predetermined gradient, and the first temperature level is increased after the temperature becomes as high as a second predetermined level wherein the second level ≧ the first level.

3 Claims, 6 Drawing Sheets

DEFROST CONTROL METHOD FOR A HEAT PUMP

BACKGROUND OF THE INVENTION

The present invention relates to a defrosting control for a heat pump and more particularly to a method of detecting frost generated on an outdoor side heat exchanger of an air-conditioner.

In general, when the outdoor temperature lowers as in winter while a heat pump is driven for heating a room, frost is generated on an outdoor side heat exchanger to cause the decrease in the heat exchange capacity of the outdoor side heat exchanger. This results in waste of electric power and a decrease in heating power. Consequently, frost on the outdoor side heat exchanger provides a serious disadvantage to the heat pump.

Under the circumstances, the refrigeration cycle is temporarily reversed to defrost the outdoor side heat exchanger, and the defrosting cycle is then switched to the heat pump to re-start the heating, such operations being carried out in repetition. There are known apparatuses for controlling such operations, which include a differential temperature detector-carrying defrosting apparatus adapted to detect the generation and nonexistence of frost on the basis of a difference between the temperature in the outdoor side heat exchanger and that of the outside air, and a mechanical timer-carrying defrosting apparatus adapted to detect the temperature in the outdoor side heat exchanger at predetermined time intervals.

In the case of the former apparatus, a differential temperature detector-carrying defrosting apparatus, defrosting is necessarily carried out every time when the temperature of the outside air decreases, so that the difference between the temperature in the outdoor side heat exchanger and that of the outside air reaches a preset level. Therefore, even when the humidity of the outside air is low with no frost generated on the outdoor side heat exchanger, the defrosting is started unnecessarily. In the case of the latter apparatus, a mechanical timer-carrying defrosting apparatus, heating is continued with the outdoor side heat exchanger being left not defrosted when this heat exchanger is in a nearly frosted state. Even when, in this case, frost generation starts on the outdoor side heat exchanger with the temperature of the outside air decreasing greatly, a defrosting operation is not started until a predetermined period of time has elapsed.

In order to eliminate such problems, as disclosed in Japanese Patent Publication No. 60-40774/1985, an attempt was made to start the defrosting when the temperature in an outdoor side heat exchanger (i.e., temperature of an indoor coil) is not higher than a preset level with a downward gradient of the temperature in the indoor side heat exchanger becoming steeper than a preset gradient.

If the defrosting is thus started, the condition of gradual formation of frost on the outdoor side heat exchanger in accordance with a decrease of the temperature in the indoor side heat exchanger is detected and, therefore, the formation and nonexistence of frost has been detected.

In the conventional defrosting control method as mentioned above, the defrosting of the outdoor side heat exchanger is done on the condition that the temperature in the indoor side heat exchanger is not higher than a predetermined level, so as to improve the accuracy of detecting the formation of frost on the outdoor side heat exchanger. Therefore, when the temperature in the indoor side heat exchanger is high, i.e., when this heat exchanger is operated in its sufficient capacity and fully exhibits its functions, an unnecessary defrosting operation (non-load defrosting) is not carried out. However, if another heater (for example, a stove) is in operation in the room in which this indoor side heat exchanger is installed, the temperature in this room becomes high due to the operation of the additional heater, so that the temperature in the indoor side heat exchanger also becomes high. Namely, even when frost is formed on the outdoor side heat exchanger with the functions of the indoor side heat exchanger not fully exhibited, the temperature in the indoor side heat exchanger becomes high, and the defrosting is not started, so that the outdoor side heat exchanger is covered with frost thicker and thicker in some cases. In such a case, the predetermined level referred to above may be set high. However, when the additional room heater is not provided in the same room (or when the heating capacity of an additional room heater operated in the room is small) with this predetermined level set high, the number of defrosting operations for a unit time increases accordingly, so that the frequency of non-load defrosting increases to cause the heating by the air-conditioner to be interrupted. Therefore, the predetermined level cannot be set high.

SUMMARY OF THE INVENTION

An object of the present invention is to provide a method of defrosting control, which can prevent non-load defrosting.

Another object of the present invention is to provide a defrosting control method, which can prevent defrosting detection errors when an additional heater is operated in the same room.

According to the present invention, there is provided a method of defrost for an outdoor side heat exchanger of a heat pump having a control means for defrosting said outdoor side heat exchanger and a refrigeration circuit, said refrigeration circuit having a compressor, an indoor side heat exchanger, an expansion device and said outdoor side heat exchanger, comprising the steps of:

detecting temperature T of said indoor side heat exchanger, starting said control means to defrost said outdoor side heat exchanger when a temperature gradient calculated on the basis of said temperature T is smaller than a predetermined negative value, and while said temperature T of said indoor side heat exchanger is lower than a threashold temperature T1 for preventing a non-load defrosting, and changing said temperature T1 to a higher temperature T2 after protecting said heat pump from an overload.

According to another embodiment of the present invention, there is provided a method of defrost for an outdoor side heat exchanger of a heat pump having a control means for defrosting said outdoor side heat exchanger and a refrigeration circuit, said refrigeration circuit having a compressor, an indoor side heat exchanger, an expansion device and said outdoor side heat exchanger, comprising the steps of:

detecting temperature T of said outdoor side heat exchanger, starting said control means to defrost said outdoor side heat exchanger when a temperature gradient calculated on the basis of said temperature T is larger than a predetermined positive value, and while a temperature of said indoor side heat exchanger is lower than a threashold temperature T1 for preventing a non-load defrosting, and changing said temperature T1 to a higher temperature T2 after protecting said heat pump from an overload.

In a further embodiment of the present invention, there is provided a method of defrost for an outdoor side heat exchanger of a heat pump having a control means for defrosting said outdoor side heat exchanger and a refrigeration circuit, said refrigeration circuit having a compressor, an indoor side heat exchanger, an expansion device and said outdoor side heat exchanger, comprising the steps of:

detecting temperature T of said outdoor side heat exchanger, starting said control means to defrost said outdoor side heat exchanger when a temperature gradient calculated on the basis of said temperature T is smaller than a predetermined negative value, and while said temperature T is lower than a threashold temperature T1 for preventing non-load defrosting, and changing said temperature T1 to a higher temperature T2 while additional heating device is operated in a room simultaneously with said heat pump.

According to the method of the present invention, when an additional heater is operated in the same room, the first temperature level becomes high enough to continue reliable defrosting.

PREFERRED EMBODIMENT OF THE INVENTION

Figure 1:
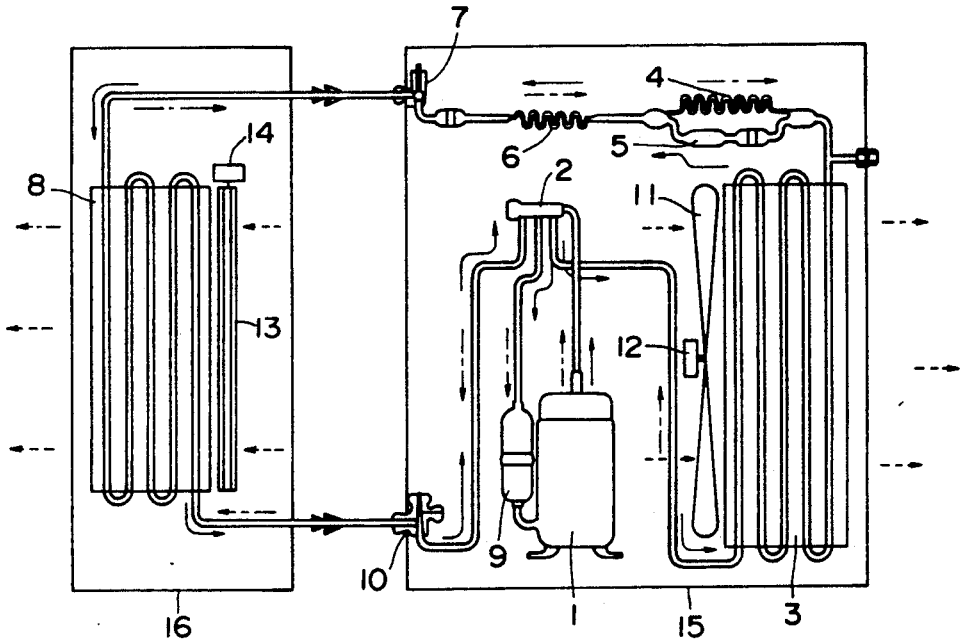
FIG. 1 is a refrigerant circuit diagram showing the refrigeration cycle of an air-conditioner used in the present invention and consisting of indoor and outdoor units.

An embodiment of the present invention will now be described with reference to the drawings. FIG. 1 is a refrigerant circuit diagram showing the outline (refrigeration cycle) of an air-conditioner consisting of an indoor unit 16 and an outdoor unit 15. Referring to this drawing, a reference numeral 1 denotes a compressor and a four-way valve 2, an outdoor side heat exchanger 3, capillary tubes 4, 6, and an indoor side heat exchanger 8 and an accumulator 9 are connected via refrigerant pipes to form a refrigerant cycle. This refrigeration cycle can be selectively shifted to a refrigeration cycle for cooling and to a refrigeration cycle for heating by switching the four-way valve 2. Referring to FIG. 1, during cooling, a compressed refrigerant discharged from the compressor 1 flows as shown by solid arrows, and the outdoor side heat exchanger and indoor side heat exchanger work as a condenser and an evaporator, respectively, the cooling being thus carried out. During this time, a check valve 5 is used to cause the refrigerant to flow shunting the capillary tube 4 as shown by a solid arrow. During heating, a compressed refrigerant discharged from the compressor flows as shown by one-dot chain arrows, and the indoor side heat exchanger and outdoor side heat exchanger work as a condenser and an evaporator, respectively, and thus the heating operation is started. When such refrigeration cycles are used, the capillary tube effectively operated during cooling is different from the capillary tube effectively operated during heating. Namely, the expansion rates are different. An outdoor unit 15 has constituent elements, such as the compressor 1 and outdoor side heat exchanger 3, and an indoor unit 16 has constituent elements, such as the indoor side heat exchanger 8. Service valves 7, 10 are adapted to connect the refrigerant pipes, which extend the indoor unit 16, to the outdoor unit 15. The refrigerant pipe connected to the service valve 7 is thinner than that connected to the service valve 10. A reference numeral 11 denotes a propeller fan, and 12 an electric motor for driving the propeller fan 11. When the propeller fan 11 is rotated, the air is sent into the outdoor side heat exchanger 3, so that the heat exchange rate therein increases. A cross flow fan 13 is connected to a shaft of an electric motor 14 and when the cross flow fan 13 is rotated, the air is sent into the indoor side heat exchanger 8, and the air cooled or heated in the indoor side heat exchanger 8 is supplied to the room.

Figure 2:
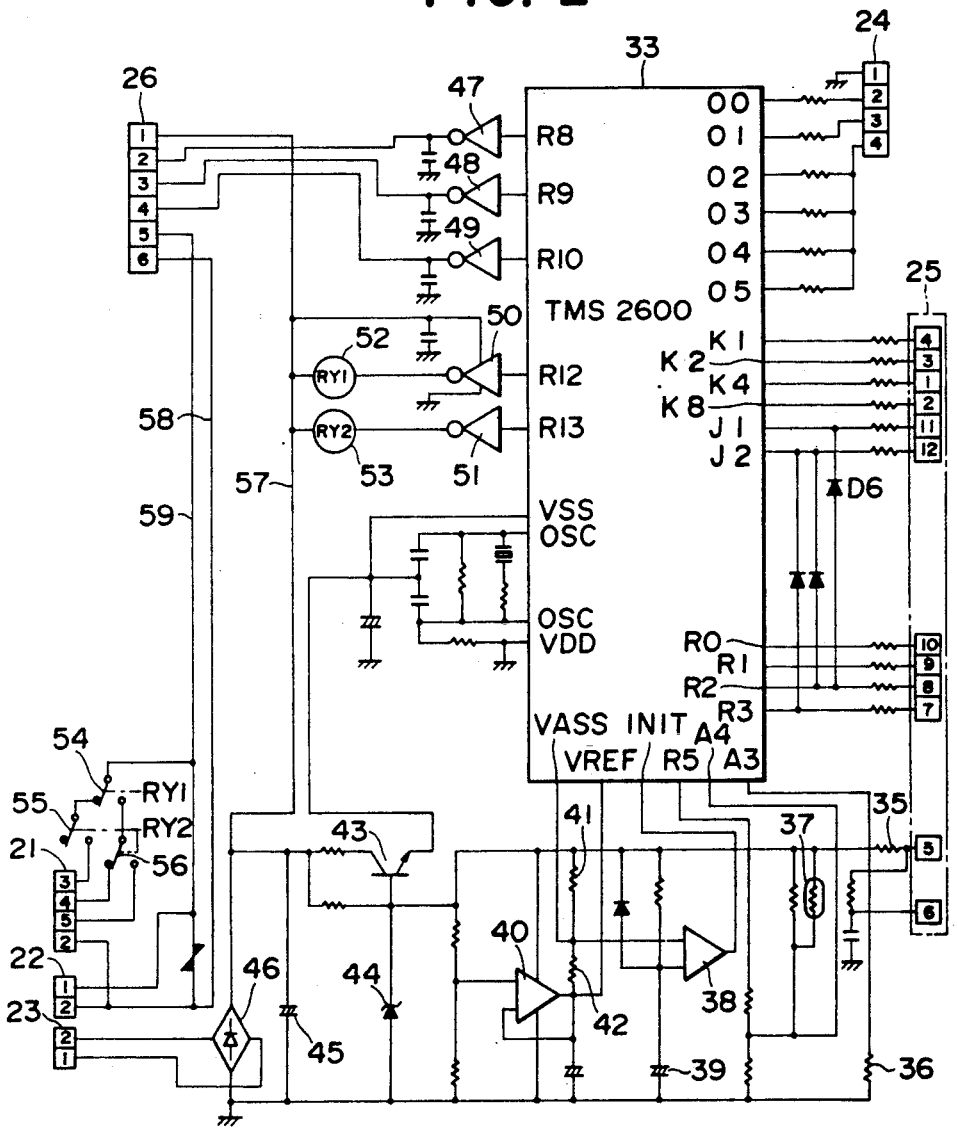
FIG. 2 is a diagram of an electronic circuit used in the air-conditioner shown in FIG. 1.

FIGS. 2-5 are diagrams of electronic circuits used for controlling the air-conditioner shown in FIG. 1. Referring to these drawings, connectors 21-23 shown in FIG. 2 are fitted in connectors 27-29 shown in FIG. 3 so that the terminals of the same numbers are connected together. The connectors 24, 25 are fitted in the connectors 30, 31 of FIG. 4 so that the terminals of the same numbers are connected together and, similarly, the connector 26 are fitted in the connector 32 of FIG. 5 so that the terminals of the same numbers are connected together. Referring first to FIG. 2, a microcomputer (TMS 2600) 33 has a plurality of input and output terminals. The main operations of the microcomputer 33 will be described presently by using a flow chart. The output terminals 00-05 are connected to the terminals of the connector 24 through resistors. The input terminals K1, K2, K4, K8, J1, J2, R0-R3 are connected to the terminals of the connector 25 through resistors. A remote controller for the air-conditioner is connected to the connectors 24, 25 and the operation data set in the remote controller is inputted by key scanning using the output and input terminals thereof.

The terminals A3, A4 are analog input terminals. A temperature sensor 34 provided in the remote controller is connected to terminals 5, 6 of the connector 25 (FIG. 4) so that the room temperature can be detected, and the temperature sensor 34 and resistors 35, 36 are series-connected to a DC power source. Since this temperature sensor 34 uses a thermistor having negative characteristics in which the resistance value therein varies according to the temperature, the level of a voltage applied to the terminal A3 varies in accordance with the variation of the room temperature. Since the terminal A3 of the microcomputer 33 has an A/D converter (analog/digital converter) therein, a digital temperature value can be obtained on the basis of an analog voltage corresponding to this temperature. This temperature value is stored in a memory in the microcomputer 33. A voltage which varies according to the temperature detected by a temperature sensor 37 is applied to the terminal A4 of the microcomputer 33 in the same manner as in the terminal A3. The temperature sensor 37 is fixed so that the temperature in the indoor side heat exchanger 8 can be detected. Accordingly, the microcomputer 33 is capable of obtaining the temperature in the indoor side heat exchanger 8 via the terminal A4 and storing it in the memory therein.

A terminal INIT of the microcomputer 33 is an initial terminal, and, when a negative edge trigger is applied to this terminal, the microcomputer 33 is reset. This trigger is outputted after the voltage of a capacitor 39 and a predetermined voltage have been compared with each other in a comparator 38. A resistance value and a value of the capacitor are set so that this edge trigger is outputted when about 0.5 second has elapsed after the starting of the supplying of a power source current. An inversion amplifier 40 is used as a voltage follower by a full feedback thereof. Therefore, two kinds of reference voltages can be obtained by using resistors 41, 42. These reference voltages are supplied to the comparator 38 as well as to terminals VREF, VASS of the microcomputer 33. A reference numeral 43 denotes a constant voltage generating transistor, the operation of which is controlled by a zener diode. An output from the transistor 43 is supplied to a power source terminal VSS of the microcomputer 33. A smoothing capacitor 45 is adapted to smooth a rectified output from a rectifier bridge 46. Output buffers 47–51 for reversing outputs are connected to the terminals R8–R10, R12 R13 of the microcomputer 33. A signal for operating the compressor 1 is outputted from the terminal R8, a signal for switching the four-way valve 2 from the terminal R9, a singal for operating the electric motor 12 is the outdoor unit 15 from the terminal R10, and a signal for changing over the speed of the electric motor 14 in the unit 16 from the terminals R12, R13. The output terminals of the output buffers 47–49 are connected to the electronic circuit shown in FIG. 5, through the terminals of the connector 26.

Relays 52, 53 are adapted to be excited by outputs from output buffers 50, 51, and the relay 52 has a changeover contactor 54 and the relay 53 has change-over contactors 55, 56. The change-over contactors 54-56 shown in FIG. 2 are in the condition with the relays 52, 53 in an OFF-state. Referring to FIG. 2 a reference numeral 57 denotes a power source line of DC+24V, and 58, 59 power source lines AC100V, the AC100V being supplied through the connector 26. Accordingly, (1) when the relays 52, 53 are in an OFF-state, the AC power source current is not supplied to the connector 21, (2) when the relay 52 is in an OFF-state with the relay 53 in an On-state, the AC power is supplied to the terminal 3 of the connector 21, (3) when the relay 52 is in an ON-state with the relay 53 in an OFF-state, the AC power is supplied to the terminal 4 of the connector 21, and (4) when the relays 52, 53 are in an ON-state, the AC power is supplied to the terminal 5 of the connector 21.

Figure 3:
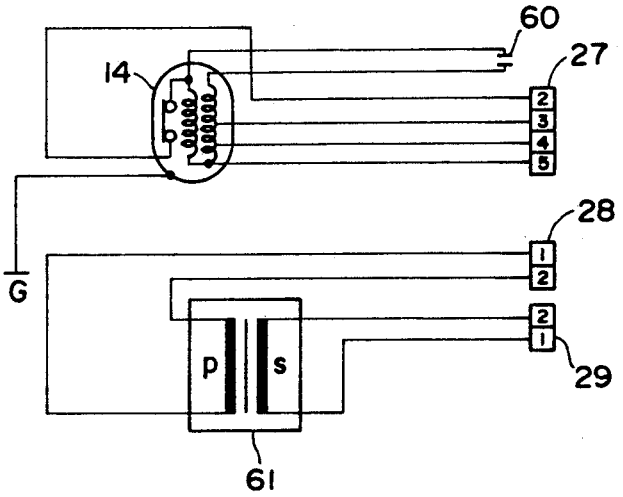
FIG. 3 is a diagram of an electric circuit connected to the electronic circuit shown in FIG. 2.

FIG. 3 shows an electric circuit connected through the connectors 21–23 shown in FIG. 2 and connectors 27–29 corresponding to these connectors, and a power source terminal of the electric motor 14 is connected to the connector 27. The terminal 2 of the connector 27 is a common terminal. Accordingly, when AC power is supplied to the terminal 3 of the connector 27, the electric motor is rotated at low rotation speed, and an air current of a low flow rate is sent out from the fan 13. When AC power is supplied to the terminal 4 of the connector 27, the motor 14 is driven at an intermediate rotation speed, and an air current of an intermediate flow rate is sent out from the fan 13. When AC power is supplied to the terminal 5 of the connector 27, the motor 14 is driven at a high rotation speed, and an air current of a high flow rate is sent out from the fan 13. A capacitor 60 is provided for operating the motor 14, and a stepdown transformer 61 is adapted to convert the AC power which is obtained through the connector 28 into an alternating current of a low voltage, and then supply this alternating current to the rectifier bridge 46 of FIG. 2 through the connector 29 and the connector 23 of FIG. 2.

Figure 4:
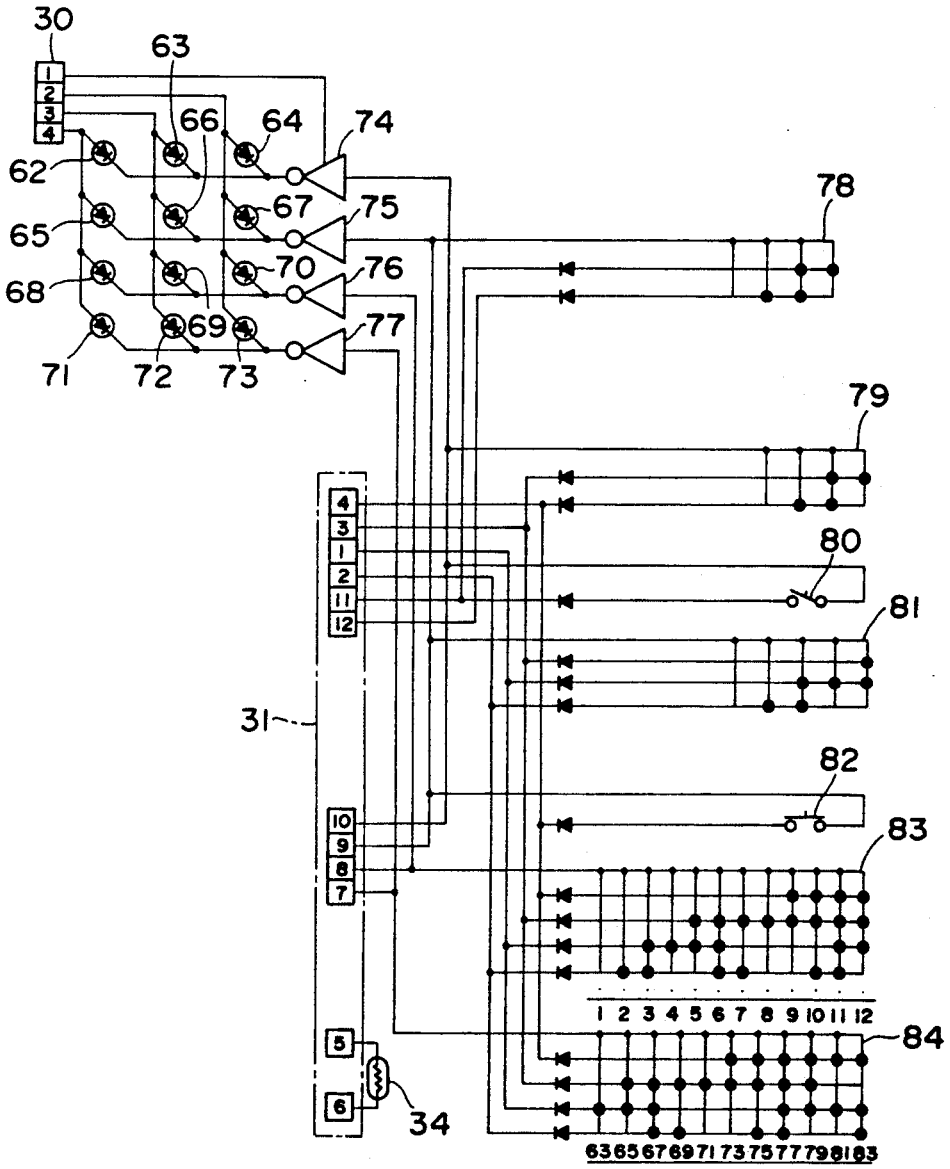
FIG. 4 is a diagram of an electronic circuit of a remote controller connected to the electronic circuit shown in FIG. 2.

FIG. 4 is a diagram of an electronic circuit of a remote controller, in which the connectors 30, 31 are connected to the connectors 24, 25 so that the terminals of the same numbers are joined together. The remote controller is separated from the electronic circuit of FIG. 2 and provided in a suitable position so that a user can operate it easily. Referring to FIG. 4, light-emitting diodes 62–75 are driven in accordance with contents of display, and output reversing output buffers 74–77 are used as buffers for lighting the light-emitting diodes 62–73. For example, in order to light the light-emitting diode 62, the voltage at the terminal 10 of the connector 30 may be set to H-level, and the voltage at the terminal 10 of the connector 31 also to H-level. Namely, an output from one of the terminals 02–05 of the microcomputer 33 and an output from the terminal R0 thereof may be set to an H-level voltage. In order to light other light-emitting diodes, the terminal of the microcomputer is selected suitably in the same manner, and an H-level voltage is outputted, whereby a desired light-emitting diode can be lit. Since the outputs from the terminals 7–10 of the connector 31 (terminals R0–R3 of the microcomputer 35) are key scanning outputs, the terminal from which an H-level voltage is outputted varies periodically. Accordingly, the light-emitting diodes 62–73 are not continuously lit, but dynamically in accordance with a scanning period.

Reference numerals 78–84 denote switches for setting the operational condition of the air-conditioner. The switch 78 is adapted to set operational modes (a mode of circulating operation in which the ventilating only is done by the indoor unit, a mode of cooling, a mode of heating and a mode of operation with cooling/heating modes automatically switched). Similarly, the switch 79 sets the number of revolutions per minute (high, intermediate and low thereof and the automatic switching of high, intermediate and low thereof) of the motor 14 in the indoor unit, the switch 80 carries out a test run, and the switch 81 changes over a set operation (ON timer operation, OFF timer operation, night setback operation, energy-saving operation and a regular operation). The switch 82 is provided to run/stop the air-conditioner, the switch 83 to set the timer-effective time during an ON/OFF timer-set operation, and the switch 83 to set the temperature in the room. The operational condition of these switches is judged from the condition of scanning outputs from the terminals R0–R3 of the microcomputer 33 and that of voltages applied to the terminals K1, K2, 4, K8, J1, J2 of the same microcomputer 33. The positions in which the switches 78, 79, 81, 83, 84 are short-circuited varies with the position of a select bar. Regarding this, a description will be given with the switch 78 taken as an example. When the select bar which moves laterally is positioned at the right end, the terminals 9, 11 of the connector 31 are connected together, and, when the select bar is in the second position from the right, the terminal 9 of the connector 31 is connected to the terminals 11, 12 thereof. When the select bar is in the third position from the right, the terminals 9, 12 of the connector 31 are connected together, and, when the select bar is in the fourth position from the right, that is, a left end, the connector 31 is in an opened state in which no terminals thereof are connected. If the connected condition of these terminals is inputted by key scanning, the microcomputer can receive the set condition of this switch. Regarding the other switches, the set condition thereof can be inputted in the same manner into the microcomputer 33.

Figure 5:
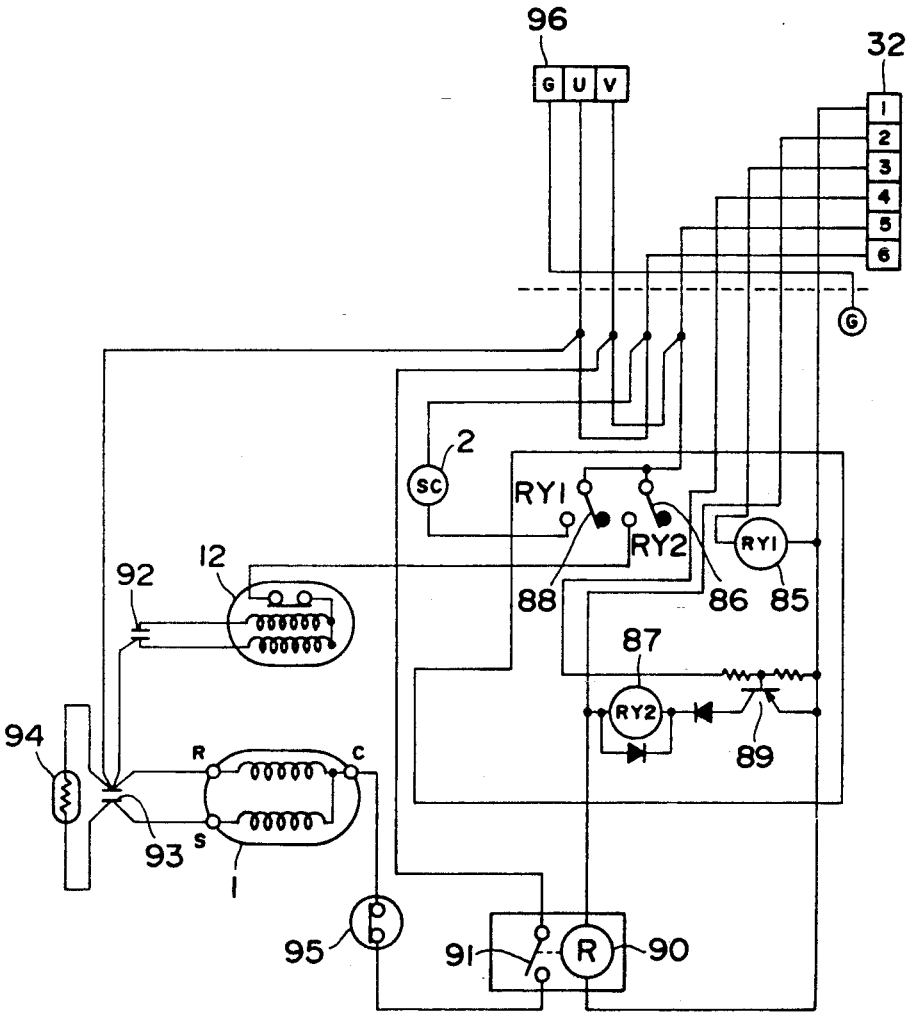
FIG. 5 is a diagram of an electric circuit of an outdoor unit connected to the electronic circuit shown in FIG. 2.

FIG. 5 is a diagram of an electric circuit in which the terminals of the connector 32 are connected to those of the connector 26 shown in FIG. 2, in such a manner that the terminal numbers agree with each other, this electric circuit being provided in the outdoor unit 15 (FIG. 1). In FIG. 5, a relay 85 is connected to the terminals 1, 3 of the connector 32. Accordingly, when an output from the terminal R9 of the microcomputer 33 shown in FIG. 2 becomes H-level, the relay 85 is turned on to close a normally-open contactor 86. A relay 90 is adapted to be turned on when an output voltage from the terminal R8 of the microcomputer 33 has become H-level, to close a normally-open contactor 91, and a relay 87 is connected to the terminals 1, 4 of the connector 32 through a transistor 89. When an output voltage from the terminal R10 of the microcomputer 53 has become H-level, the transistor 89 is turned on first. If the relay 90 is turned on (compressor operation condition) at this time, the relay 87 is turned on, a normally-open contactor 88 is closed. Therefore, when there is no compressor operating signal, the electric motor 12 is not operated.

A terminal 96 is connected to an AC power source, and a terminal G is an earth terminal. A single-phase AC power source is connected to terminals U, V. A part of the electric current from this AC power source is supplied to the terminals 5, 6 of the connector shown in FIG. 2, through the terminals 5, 6 of the connector 32. The electric current from the AC power source is also supplied to the motor 12 through the normally-open contactor 86, to the four-way valve 2 through the normally-open contactor 88, and to the compressor 1 through a normally-open contactor 91. A capacitor 92 is provided for operating the motor 12, and capacitor 93 is provided for operating the compressor 1. A compressor starting thermistor 94 of positive characteristics is connected to the capacitor 93. When the compressor 1 is started, the temperature of the thermistor 94 is low, and the inner resistance thereof is small, so that a large current flows to the compressor 1 to enable an auxiliary winding of the compressor to be used for starting the compressor. When an electric current flows through the thermistor 94 of positive characteristics, it is self-heated, and the temperature thereof increases with the inner resistance thereof becoming high. Consequently, the electric current stops flowing through the thermistor 94, and the auxiliary winding works to form a rotating magnetic field by a capacitor 93. An overload relay 95 is adapted to open its contactor to cut off the current flowing to the compressor 1 when the temperature of the compressor 1 becomes abnormally high or when an abnormal current flows to the compressor 1.

In the air-conditioner thus constructed, an air-conditioning operation is carried out by controlling the compressor 1, motor 12 and four-way valve 2 on the basis of conditions set by the switches 78–84.

Figure 6:
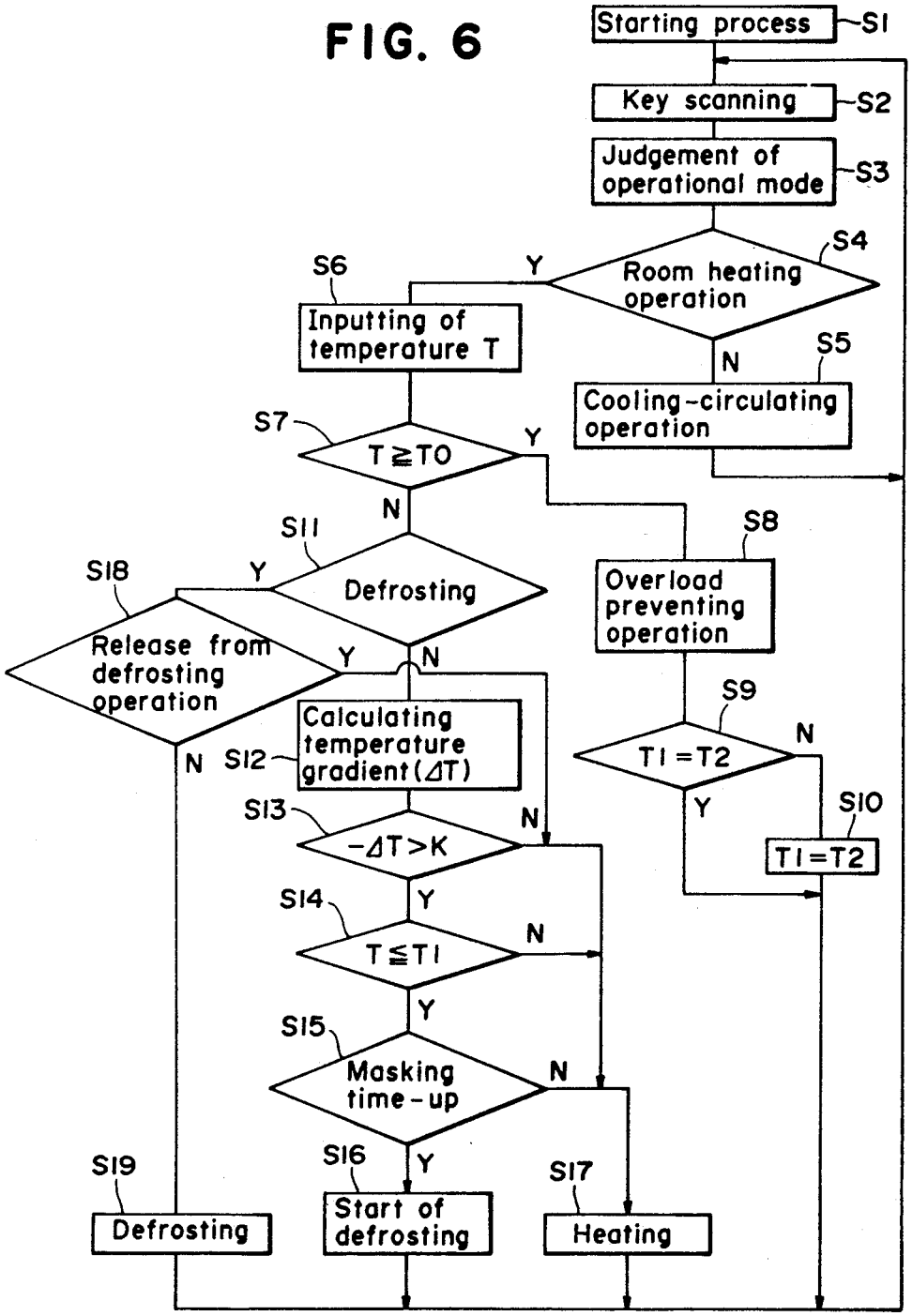
FIG. 6 is a flow chart showing the main operations of a microcomputer shown in FIG. 2.

FIG. 6 is a flow chart showing main operations of the microcomputer 33 (main operations of the air-conditioner) shown in FIG. 2. First, in Step S1 in this flow chart, a starting process (the initialization of the microcomputer and the initial setting of operational condition of the air-conditioner) is carried out. In Step S2, the key scanning is then done to judge the set condition and operating condition of the switches 78–84 and store the results in an internal memory after updating the data therein. In Step S3, the set condition of the switch 78 is read out from this memory, and, in Step S4, the set condition is judged whether it indicates a heating operation or not. When the switch 78 is set to a mode of automatically switchable cooling/heating operation, the operation is set automatically on the basis of the room temperature at which the operating switch is set to an operation mode, and the cooling/heating is thereafter switched automatically on the basis of a varying difference between the set temperature and room temperature. When the heating is not carried out, i.e., when the cooling or the circulating operation is desired to be carried out, the next procedure in Step S5 is taken, and the cooling or the circulating is carried out. The cooling is carried out by controlling the operation of the compressor 1 with a cooling refrigeration circuit of FIG. 1 used, in such a manner that a room temperature becomes equal to set level. During this time, the motor 14 provided in the indoor unit 16 is driven at a rotation speed set by the switch 79. When this switch is set in an automatically high, intermediate and low speed switchable mode, the switching of the rotational speed of the motor 14 is done so that the number of revolutions per minute increases in proportion to the difference between the set temperature and room temperature. When the heating is decided in Step S4, the flow shifts to Step S6.

In Step S6, the temperature T in the heat exchanger, i.e. the temperature T in the indoor side heat exchanger 13 in the indoor unit 16 is inputted. This temperature T is a temperature detected by the temperature sensor 37, received at the terminal A4 of the microcomputer 33 and stored in the memory therein. This temperature T is then judged whether $T \geqq T0$ or not. Namely, the air-conditioner is judged whether it is a high-load condition or not. When $T \geqq T0$ is satisfied, the flow shifts to Step S8 to carry out a high-load preventing operation. The high-load preventing operation is a protective action made when the temperature in the indoor side heat exchanger 8 becomes abnormally high. The temperature in this heat exchanger 8 becomes abnormally high when the heating is carried out at a high room temperature, when the room temperature becomes high due to an additional heater is operated in the same room, when the temperature of the outside air is abnormally high to cause the refrigerant condensation temperature to become high, and when the air is not sent to the indoor side heat exchanger 8 due to the failure of the motor 14 in the indoor unit to cause the heat exchange rate of the heat exchanger 8 to lower. At such time, the high-load preventing operation is started by increasing the number of revolutions per minute of the motor 14 in the indoor unit, stopping the operation of the motor 12 in the outdoor unit, reducing the operational capacity of the compressor 1 when this capacity is changed, and stopping the operation of the air-conditioner in the worst case. The temperature T0 at which such a high-load preventing operation is carried out is set to 60°–80° C. This temperature T0 is set to an optinum level in each type of air-conditioner in accordance with the capacities of the compressor 1, indoor side heat exchanger 8 and outdoor side heat exchanger 3. After the operation in Step 8 has been carried out, a subsequent procedure in Step 9 is taken to judge whether or not T1=T2. The T1 and T2 are values which were initialized in Step S1, and these values have a relation, T0>T2>T1, in an initial condition. When T1=T2 is not satisfied, the flow shifts to Step S10, and T1 is replaced with T2. Namely, if a high-load preventing operation is carried out even once after the starting of the operation of the air-conditioner, the value of T1 is necessarily replaced with that of T2 by proceeding through these Steps S9 and S10.

When occurrence of a high-load operation is not detected in Step S7, the flow shifts to Step S11. In Step S11, a judgement as to whether defrosting is being carried out or not is made first. The defrosting will be described presently. When a judgement that the defrosting is not carried out is made in Step S11, the flow shifts to Step S12. In Step S12, a temperature gradient ΔT is calculated. The detection of the temperature in the indoor side heat exchanger 8 is done constantly at a predetermined cycle (every one cycle of a program in the microcomputer 33) by the temperature sensor 37. Noise and erroneously detected temperatures are removed from the temperature data thus obtained, and correct temperature data are stored in the memory. These temperature data are read out from the memory at a predetermined cycle to calculate periodic temperature gradients. The predetermined cycle for reading these temperatures differs according to the capacity of an air-conditioner, and, in this embodiment, such a cycle is determined as follows. First, the temperature data are read out from the memory every one minute, and a temperature gradient ΔT is calculated on the basis of the difference between these temperature data and the temperature data obtained six minutes earlier. Namely, a six-minute cycle temperature gradient is calculated every one minute.

In Step S13, a judgement is made as to whether this gradient ΔT satisfies −ΔT>K three times in repetition or not. Namely, a judgement as to whether the temperature has changed in a decreasing direction or not is made. The variation range K is represented by a positive number, and this number is set to K=0.8 in this embodiment. After the condition in Step S13 have been satisfied, the flow shifts to step S14. In Step S14, a judgement is made as to whether the temperature data T actually stored in the memory satisfies T<T1 or not. The T1 represents a threshold temperature value for preventing non-load defrosting. If the T1 is set, the erroneous starting of the defrosting can be prevented, for example, when a load in a room varies (when the door for the room is opened to cause the cold air to blow thereinto) when the condensation temperature in the indoor side heat exchanger is sufficiently high with the outdoor side heat exchanger not yet frosted, to cause the temperature in the indoor side heat exchanger to lower. The T1 is set to be T1=40° C. in this embodiment. This value is varied according to the capacity and design of the air-conditioner in the same manner as the value of T. When the condensation temperature (the temperature at which the air is discharged into the room) in the indoor side heat exchanger is set high, the value of T1 is preferably set high as well. When the condensation temperature is set to around 60° C., T1 is equal to 40 (T1=40). When the condensation temperature is set to around 70° C., it is preferable that T1 be set to about 50 (T1=50). When a compressor of a larger capacity is used with the condensation temperature unchanged, the value of T1 can be set higher.

The value of T1 is replaced with that of T2 by proceeding through Step S10. Namely, when a high-load preventing operation is started once, the value of T1 is reset to a higher level. The value of an increase of T1 is set to about +15° C. in this embodiment. Increasing the value of T1 in this manner means that the threshold value for the non-load defrosting mentioned above is set higher. In general, when an additional heater besides the air-conditioner of the present invention is being operated in the same room, the room temperature increases due to the heat generated by this additional heater, and the outdoor side heat exchanger is frosted. Even when the function of the indoor side heat exchanger is not fully exhibited, the temperature of a room, especially, the temperature of the upper portion of the interior of a room in which the indoor side heat exchanger is provided becomes high, so that the temperature in the indoor side heat exchanger also becomes high (not lower than T1). Consequently, the defrosting is not started in some cases. In order to prevent such a phenomenon, the value of T1 is increased. A judgement as to whether an additional heater is being operated or not in the room is made in Step S7. Namely, when both the heating of an air-conditioner and that of an additional heater are utilized at a time, the condensation capacity of the indoor side heat exchanger becomes larger if frost is not formed in the outdoor side heat exchanger, and the temperature in the indoor side heat exchanger becomes high with the room temperature increasing due to the heat generated by the additional heater. This causes the air-conditioner to be put in a high-load condition. Accordingly, if a judgement that the air-conditioner is in a high-load condition is made in Step S7, a conclusion that there is an additional heater in operation in the same room can be made.

When the conditions in Step S14 are satisfied, the flow shifts to Step S15. In Step S15, a judgement as to whether the masking time has terminated or not is made, and, if the masking time has terminated, the defrosting is started in Step S16. The masking time represents the time for a continuous operation of the compressor, and, while a compressor operation signal is outputted, the defrosting is not started until the masking time has passed. The masking time is set to 20 minutes in this embodiment. When the compressor is stopped, or, when a compressor stopping signal is outputted (when the room temperature has agreed with a set level), the masking time is considered to have terminated, and the flow shifts to Step S16, S18, S19 to start the defrosting. When the conditions in Steps S13–S15 are not satisfied, the flow shifts to Step S17 to continue the regular heating.

Figure 7:
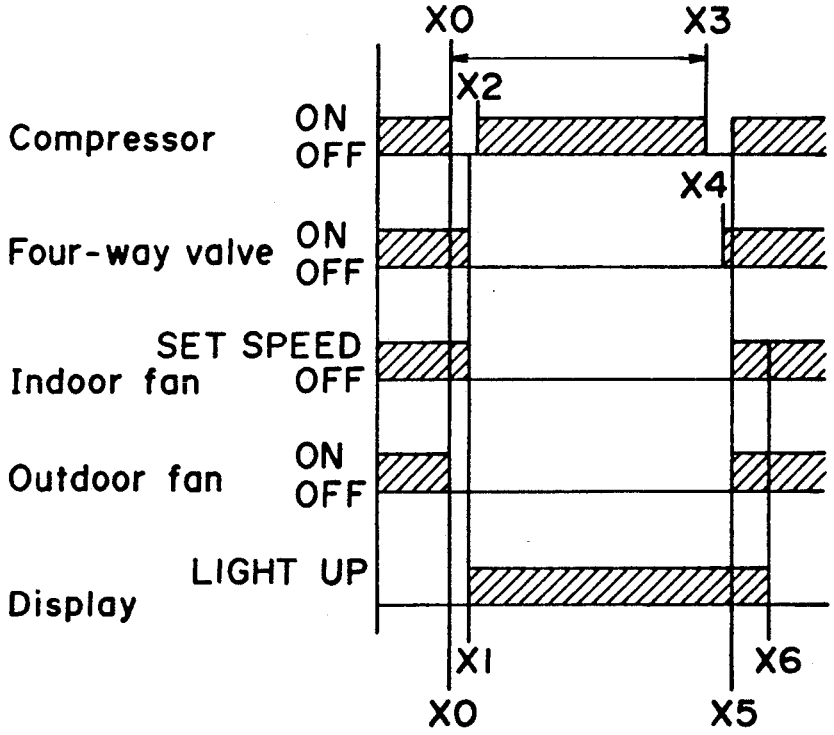
FIG. 7 is a timing chart for defrosting.

FIG. 7 is a timing chart of the defrosting. Referring to this timing chart, the defrosting is started at X0. When the defrosting is started, the compressor 1 is stopped, and the outdoor fan (motor 12 in the outdoor unit) at the same time. At X1, which is somewhat later than X0, the four-way valve is turned off, and the refrigeration cycle is switched from the heating cycle to the cooling cycle, and at the same time the indoor fan (motor 14 in the indoor unit) is stopped. The display (lighting of a light-emitting diode) of the necessity of the defrosting operation is done at X1 at once. At X2, the operation of the compressor is started. Accordingly, an operation using the cooling refrigeration cycle is started with the motors 12, 14 stopped. Consequently, the outdoor side heat exchanger works as a condenser, and the frost formed on the same heat exchanger is melted with the resultant-condensation heat. This operation is continued until X3. The X3 is an instant at which the defrosting finishes. The time between X0 and X3 is set to 12 minutes at most. When 12 minutes have passed, the defrosting ceases even if frost remains on the outdoor side heat exchanger. The defrosting may be terminated when the temperature detected by a temperature sensor, which is provided in the outdoor side heat exchanger, has become as high as a predetermined level. When the defrosting has terminated at X3, the four-way valve is turned on to switch the refrigeration cycle to the heating cycle, and the operations of the compressor, indoor fan (motor 14) and outdoor fan (motor 12) are started again. The time between X5 and X6 is a cold air preventing period. This cold air preventing period can prevent the cold air in the room from blowing out, by delaying the time at which the indoor fan (motor 14) attains a preset number of revolutions per minute in accordance with the temperature rise in the indoor heat exchanger. The displaying of a defrosting operation continues until the time X6.

When such defrosting as the above has been completed, the regular heating is stated again.

In the above embodiment, although the temperature of the indoor side heat exchanger is measured by a single temperature sensor, more than one temperature sensor may be provided. In such a case, the temperature sensors are preferably set at separate portions, for example, the inlet and outlet portions of the indoor side heat exchanger.

A temperature sensor may also be provided in the outdoor side heat exchanger so that frosting on the same heat exchanger can be judged with reference to the gradient of the temperatures measured by this temperature sensor. When the outdoor side heat exchanger is frosted, the evaporation pressure of the refrigeration circuit generally lowers, so that the heat exchanging capacity thereof also lowers. Accordingly, a comparison between the temperature of the non-frosted outdoor side heat exchanger and that of the frosted outdoor side heat exchanger shows that the temperature of the frosted one is higher. The frosting can be determined by detecting a variation of the temperature (temperature rise) of the outdoor side heat exchanger. Therefore, if the way of "calculating temperature gradient" in Step S12 in the flow chart of FIG. 6 is changed to the same way of calculating a gradient of temperature of the outdoor side heat exchanger with Step S14 changed to "gradient $(\Delta T) > K'$", the other steps can be used in a similar manner. The value of $K'$ may be set in optimum on the basis of the capacities of the compressor and the outdoor side heat exchanger in the same manner as that of the K mentioned previously.

When the outdoor side heat exchanger is frosted to cause the indoor side heat exchanger temperature to lower during the heating as mentioned above, a judgement that a gradient of decreasing temperature occurs in the indoor side heat exchanger is made, and the defrosting is started. When a room heater, which is other than the air-conditioner, is operated in the air-conditioned room, the load on the air-conditioner increases correspondingly to the heat generated by this additional room heater and by heating the same room therewith, so that the air-conditioner is placed in an overload condition. If this overload condition is detected, the presence or absence of such the additional heater can be determined. When the heater is operated, a threshold temperature value for starting the defrosting is set higher to enable the defrosting to be started reliably.

As described above, according to the present invention, temperature sensor means is provided so that the temperature of the indoor side heat exchanger can be detected, and the defrosting is started when the temperature is not higher than a first predetermined level with a downward gradient, which is calculated on the basis of the detected temperature, of the same temperature becoming sharper than a predetermined gradient, the first temperature level being increased after the detected temperature has become higher than a second predetermined level (second level $\geqq$ first level). Consequently, when the temperature of the room being heated becomes high due to energizing of the additional heater in the room, the level of the first temperature is changed to be higher to enable the defrosting to be started easily, and therefore the defrosting can be started reliably.

The temperature sensor means has a first temperature sensor for measuring temperatures on the basis of which a downward gradient of the temperature of the indoor side heat exchanger is calculated, and a second temperature sensor for detecting the first and second temperature levels. Accordingly, the temperature sensors can be provided in a suitable position for detecting speedily the variation of the temperature of the indoor side heat exchanger. Therefore, the detection of the frosting on the outdoor side heat exchanger can be done speedily.

A temperature, at which a judgement is made that the air-conditioner protects from an overload operation, is used as the second temperature, and this makes it unnecessary to provide any special temperature sensor for judging whether there is an additional heater in operation in the same room. Therefore, the temperature sensor for determining an overload condition of the air-conditioner can be used for this purposes as well.

In another embodiment of the invention, an indoor side temperature sensor capable of detecting the temperature of the indoor side heat exchanger, and the outdoor side temperature sensor capable of detecting the temperature of the outdoor side heat exchanger are provided, and a defrosting operation is started while the temperature detected by the indoor side temperature sensor is not higher than the first temperature level with an upward gradient, which is calculated on the basis of the temperature detected by the outdoor side temperature sensor, of the same temperature becoming sharper than a predetermined gradient, the first temperature level being changed to a higher level after the temperature detected by the indoor side temperature sensor has reached a level not lower than the second predetermined temperature (second temperature $\geqq$ first temperature). Accordingly, the frosting on the outdoor side heat exchanger can be detected on the basis of the variation of the temperature therein, this making it possible to conduct the detection of frosting with a high accuracy. Moreover, the frosting can be judged by the outdoor unit, so that the air-conditioner control responsibility can be shared between the indoor unit and outdoor unit.

What is claimed is:

1. A method of defrost for an outdoor side heat exchanger of a heat pump having a control means for defrosting said outdoor side heat exchanger and a refrigeration circuit, said refrigeration circuit having a compressor, an indoor side heat exchanger, an expansion device and said outdoor side heat exchanger, comprising the steps of:

detecting temperature T of said indoor side heat exchanger, starting said control means to defrost said outdoor side heat exchanger when a temperature gradient calculated on the basis of said temperature T is smaller than a predetermined negative value, and while said temperature T of said indoor side heat exchanger is lower than a threshold temperature T1 for preventing a non-load defrosting, and changing said temperature T1 to a higher temperature T2 after protecting said heat pump from an overload.

2. A method of defrost according to claim 1, wherein said overload is detected when said temperature T of said indoor side heat exchanger is higher than a predetermined temperature.

3. A method of defrost according to claim 2, wherein said predetermined temperature is equal to said temperature T2.

* * * * *